United States Patent [19]

Yoneyama et al.

[11] Patent Number: 4,792,238

[45] Date of Patent: Dec. 20, 1988

[54] CONTINUOUS DISPERSION APPARATUS HAVING MULTI-STEP DISPERSION CHAMBERS

[75] Inventors: Yoshihisa Yoneyama; Yasuo Iwasaki, both of Shizuoka, Japan

[73] Assignee: Pola Kasei Kogyo Kabushiki Kaisha, Shizuoka, Japan

[21] Appl. No.: 871,429

[22] PCT Filed: Sep. 11, 1985

[86] PCT No.: PCT/JP85/00506

§ 371 Date: May 9, 1986

§ 102(e) Date: May 9, 1986

[87] PCT Pub. No.: WO86/01742

PCT Pub. Date: Mar. 27, 1986

[30] Foreign Application Priority Data

Sep. 11, 1984 [JP] Japan ..... 59-188940

[51] Int. Cl.[4] ..... B01F 7/16; B01F 15/06

[52] U.S. Cl. ..... 366/307; 366/87; 366/149; 366/325

[58] Field of Search ..... 366/302, 307, 290, 87, 366/291, 292, 293, 303, 304, 279, 144, 149

[56] References Cited

U.S. PATENT DOCUMENTS

| | | | |
|---|---|---|---|
| 1,587,115 | 6/1926 | Govers | 366/303 |
| 3,143,395 | 8/1964 | Milmore | 366/290 |
| 3,604,690 | 9/1971 | Traelners | 366/303 |
| 3,695,586 | 10/1972 | Griffin | 366/279 |
| 3,807,703 | 4/1974 | Day . | |
| 4,400,219 | 8/1983 | Vanderputten et al. | 366/290 |
| 4,624,419 | 11/1986 | Heuesi et al. | 366/279 |

FOREIGN PATENT DOCUMENTS

| | | | |
|---|---|---|---|
| 200972 | 2/1956 | Australia | 366/302 |
| 535644 | 11/1927 | Fed. Rep. of Germany | 366/303 |
| 2339530 | 4/1974 | Fed. Rep. of Germany . | |
| 37739 | 4/1978 | Japan . | |

*Primary Examiner*—Harvey C. Hornsby
*Assistant Examiner*—Joseph S. Machuga
*Attorney, Agent, or Firm*—Birch, Stewart, Kolasch & Birch

[57] ABSTRACT

An apparatus having a cylindrical structure which has therein a rotary shaft extending along the axis of the cylindrical structure to project beyond the lengthwise end portions thereof, and a plurality of dispersion chambers and an arbitrary number of rectifying chambers arranged along the rotary shaft can be used for continuous dispersing in the manufacture of several products. Each of the dispersion chambers and rectifying chambers consists of a space defined by the circumferential surface of the rotary shaft and between adjacent distance collars. Each of the distance collars is fixed at its outer circumferential surface to the inner surface of the cylindrical structure, and forms at a part of its inner circumferential surface in cooperation with the circumferential surface of the rotary shaft an annular slit which constitutes a passage for a material current. The dispersion chamber houses in the inner space thereof a rotary blade having a shearing edge, and fixed to the rotary shaft so that the rotary blade extends at right angles to the longitudinal direction of the rotary shaft. The rectifying chamber houses in the inner space thereof a bearing for the rotary shaft, which is fixed to the inner surface of the cylindrical structure and provided with a plurality of small gaps which constitute passages for the material current.

8 Claims, 6 Drawing Sheets

FIG. 5 - a
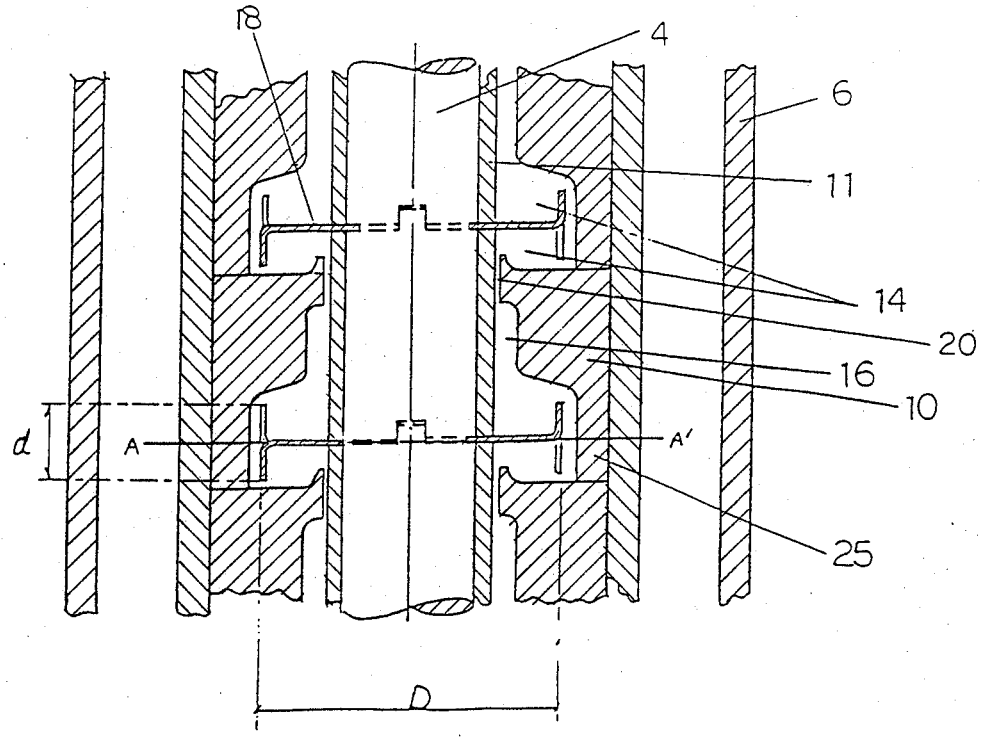
FIG. 5 - b
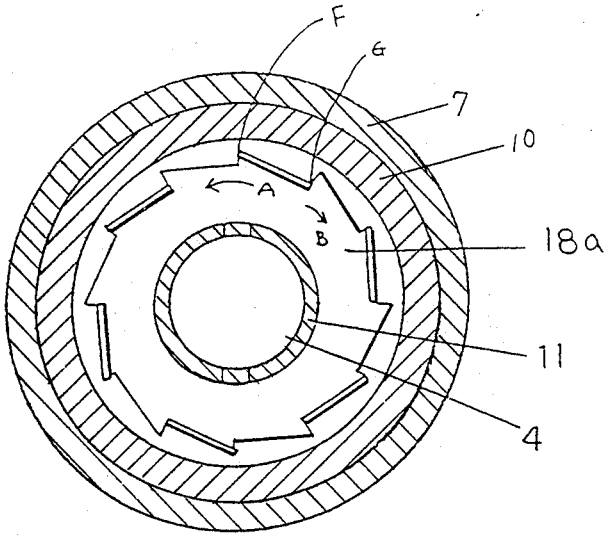

FIG. 13
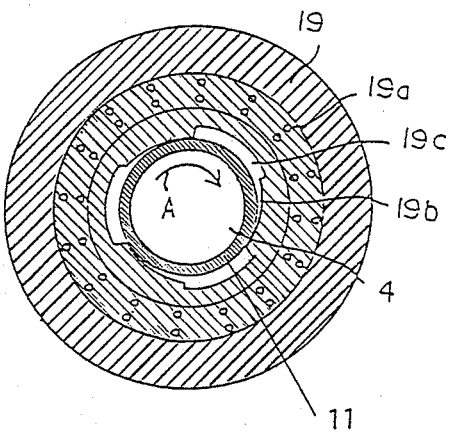
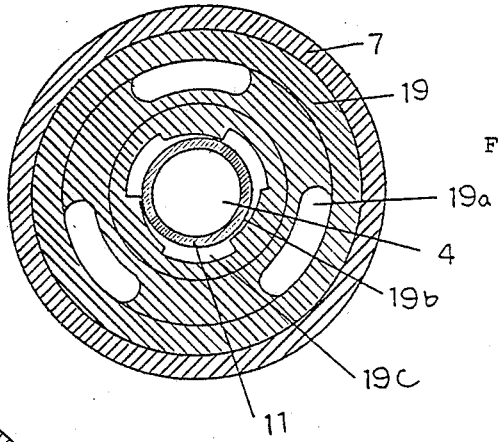
FIG. 14
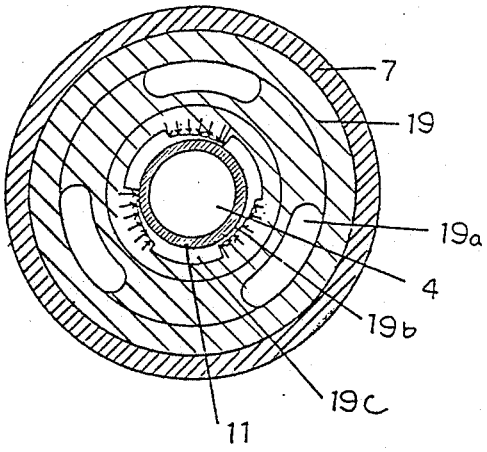
FIG. 15

CONTINUOUS DISPERSION APPARATUS HAVING MULTI-STEP DISPERSION CHAMBERS

TECHNICAL FIELD

The present invention relates to a continuous dispersion apparatus utilizable for the manufacture of products in dispersed or emulsified state, for example, in the fields of cosmetics, foods, paints, fuels and car waxes. More particularly, the present invention relates to a continuous dispersion apparatus capable of dispersibly mixing hardly miscible aqueous and oily phases to produce an oil-in-water type or water-in-oil type state or of efficiently producing a dispersed state of a solid phase such as a powdery substance in an aqueous and/or oily phase.

DESCRIPTION OF THE BACKGROUND ART

A manufacturing apparatus for the production of cosmetics such as cream and emulsion, emulsified foods, paints and the like dispersions is known having (1) a vacuum emulsifier, (2) an open emulsifier and (3) a continuously stirring and kneading reaction heat exchanger (the so-called mixing reactor or scraped surface heat exchangers).

The emulsifier effectuates stirring and emulsification under vacuum in a confined state. The emulsification is carried out under vacuum so that the emulsifier is suitable for the manufacture of sterilized products and aerial bubble-free products.

The open emulsifier has been used for some time. In this open emulsifier, aerial bubbles tend to enter on emulsification and evaporation of water and the like occurs during stirring for emulsification at a high temperature. In general, evaporation of an amount of about 2–5% based on the amount charged occurs, although it varies according to the recipe and the amount for batch. Further, careful attention should be paid to the heating temperature, heating time, stirring speed and the like. A cream manufactured by the open emulsifier contains about 2–10% by weight of aerial bubbles as compared with a cream manufactured by a vacuum emulsifier. In case the resultant cream is charged into a bottle or the like container, therefore, the amount to be charged will be decreased by the amount corresponding to the aerial bubbles.

The following points are mentioned as problems existing commonly in the above described vacuum and open emulsifiers:

① On account of a batchwise system, an emulsifying tank will inevitably become larger so that it takes much time to charge the tank with materials and to discharge the emulsion from the tank,thus making the system inefficient.

② As the emulsifying tank is larger, little turbulence occurs and dead spaces also tend to be formed. Accordingly, cutting of particles with blades of a propeller hardly tends to be effected completely and evenly so that an entire emulsion will hardly be formed even after the lapse of a sufficient time.

③ As the emulsifying tank is larger, it is difficult to obtain the number of revolutions necessary for cutting particles (desirably at least 6,000 r.p.m.). However, only about 3,000 r.p.m. is obtained with a drive having power as high as 7 horse power or more for a tank with a capacity of 300 liters and a drive as high as 15 horse power or more for a tank with a capacity of 1,000 liters, thus making the operation uneconomical.

④ As the apparatus is large, a number of employees are required for the operations. Moreover, a lot of cost is required if the apparatus is additionally installed.

⑤ On account of a batchwise system, much time is necessary for the production of an emulsion and a warmth-maintaining device is required in some cases, thus making the operation uneconomical.

A substantial structure is required for the continuously stirring and kneading reaction heat exchanger as discussed above wherein starting materials dissolved in a starting materials-dissolving tank are emulsified in a preliminary emulsifying tank and the preliminarily emulsified starting materials are supplied in a constant amount by a metering pump to a mixing reactor. This arrangement is fundamentally a cylinder with a jacket and the interior of the cylinder (where emulsification by stirring is effected) provided with protuberant blades or scraping blades rotatable at a speed of about 100–600 r.p.m. In general, the emulsification by stirring is effectuated in the cylinder with a jacket and then the product is rapidly cooled in a cooling cylinder and is continuously discharged. Further, there is also known a system wherein starting materials are fed, without using any preliminary emulsifying tank, from the starting materials-dissolving tank directly to the body of the mixing reactor for emulsification by the aid of a metering pump and then the product rapidly is cooled in a cooling cylinder and is continuously discharged therefrom. The former is called the non-proportional system and the latter the proportional system.

It is characteristic of this apparatus that quick cooling of the product is possible and that the product can continuously be discharged. However, this apparatus has drawbacks is that cleaning of the interior of the cylinder where blades of a complicate shape are positioned becomes incomplete and that the product is rapidly cooled so that control becomes difficult in a recipe system which requires gradual cooling. In any of the non-proportional and proportional systems, the quality of the product may not be definite between the product obtained in the initial stage of the production and that in the latter stage of the production.

A continuously mixing and emulsifying apparatus having a plurality of mixing chambers is also known. Such an apparatus is disclosed in U.S. Pat. No. 3,807,703 and DOS No. 2,339,530. A mixing and emulsifying apparatus of this type relates to an apparatus developed chiefly for efficiently producing polyurethane and the like. The mechanism of the mixing and emulsification is characterized in that the mixing and emulsification are effected in an axial flow state caused by a voltex effect according to the Stokes principle by the action of a rotor shaped to have a specific element based on turbine blades or propeller blades installed in the housing and that the starting material flow in a steady flow state existing in the neighborhood of the outer layer in the housing is changed to a non-steady flow state by the action of a baffle bar thereby enhancing the mixing efficiency.

In case of manufacturing an emulsion having a very small particle size or a highly viscous emulsion (for example, a cream) or dispersion (for example, a pigment paste) of a high inner phase (the state wherein the content of a dispersion phase is greater than that of a matrix phase), however, this mixing and emulsifying apparatus has serious drawbacks as will be described hereinafter.

1. As the rotor is a one-end-supported type, its rotation becomes eccentric so that a limitation exists preventing at a high speed. Accordingly, the apparatus can be applied for an ordinary emulsion (for example, a particle size within the range of 1–100μ, optimally 1–5μ) but can hardly be applied to the manufacture of an emulsion of very fine particles which requires a high speed of rotation as an indispensable condition.

2. Since the action of this mixing and emulsifying apparatus is based on mixing and emulsification by a vortex effect, it is difficult to divide particles into those of less than a certain definite size even if a high speed of rotation is possible.

3. Even if the shape of the element is changed so as to impart a shearing force, a baffle bar installed in the housing constitutes an obstacle so that a fluid boundary layer portion in the neighborhood of the outer layer in the housing forms a dead space, thus giving only an unhomogeneous and unstable emulsion. Especially, in case of the fluid starting materials having a high viscosity like an emulsion of a high inner phase type, any baffle action by a baffle bar (conversion of a steady flow into a non-steady flow) cannot be expected so that this tendency becomes more significant.

4. Emulsification proceeds in such a manner that the fluid starting materials are repeatedly passed through an orifice formed between a land and a bore always in turbulent state. Thus, the emulsion tends to become unhomogeneous, having a wide range of particle diameters. On agitation at a high speed, the fluid starting materials per se are heated. In this mixing emulsifier, however, the heat conversion rate is so poor that the emulsion tends to be denatured thermally.

Furthermore, the apparatus itself had the following problems:

1. As the rotor is of an integrated type, the rotor requires construction by a split die type and, as a result of the construction, liquid contents tend to leak out.

2. As the rotor is of a one-end-supported type, a limitation exists in the number of dispersion chambers to be installed.

3. As the mixing is fundamentally based on a vortex action, the internal pressure in the housing becomes unstable, thus making control of the flow rate difficult.

Thus, an apparatus which satisfies the following conditions is now greatly demanded in view of such prior problems:

1. An apparatus operable continuously for emulsification and dispersion and applicable to starting components an materials having a wide range of viscosities.

2. A continuous treatment is possible from charging starting materials to discharging products without the necessity of effecting any preliminary dispersion.

3. A loss of shearing energy on carrying out dispersion is so little that a significant saving of energy is possible as compared with the known conventional apparatus.

4. Energy conversion toward a fluid is made so stable that products having desired particle diameters may be obtained steadily.

5. Thermally unstable starting materials can also be processed without any problem.

SUMMARY OF THE INVENTION

The present invention provides the following continuous dispersion apparatus: having multi-step dispersion chambers which comprises a body of a cylindrical structure having a sealing assembly on both ends thereof provided with a plurality of inlets for starting materials and an outlet for a dispersion product, a rotary shaft extending i the cylindrical structure in a lengthwise direction along the central axis of the cylindrical structure beyond both ends thereof, and a plurality of dispersion chambers arranged along the rotary shaft so as to disperse a starting material current from the inlet in the dispersed chambers and to discharge a dispersed product from the outlet, characterized in that a starting material-supplying chamber, a plurality of the dispersion chambers and an arbitrary number of the rectifying chambers are involved in the cylindrical structure in such a manner that the starting material-supplying chamber consists, at one end of the cylindrical structure, of a space defined by combining the circumference of the cylindrical structure passages for the starting materials from the plurality of the inlets and the dispersion chambers and the rectifying chambers are arranged on the circumference of the rotary shaft from one end to the other end thereof along the axis, each of the dispersion chambers and the rectifying chambers consisting of a space defined by the circumferential surface of the rotary shaft, one distance collar and an adjacent distance collar thereof. The distance collar is fixed at the outer circumferential surface to the inner wall of the cylindrical structure. At a part of the inner circumferential surface thereof together with the circumferential surface of the rotary shaft, an annular slit is formed which constitutes a passage for the starting material current supplied from the starting material-supplying chamber. The dispersion chamber in the internal space thereof having a rotary blade with shearing edges which is fixed to the rotary shaft and extends therefrom at a right angle to the lengthwise direction of the rotary shaft. The rectifying chamber in the internal space thereof is provided with a bearing for the rotary shaft, which is fixed to the inner wall of the cylindrical structure and provided with a plurality of small gaps which constitute passageways for the starting material current. Further, the present invention also provides for the above described continuous dispersion apparatus having multi-step dispersion chambers wherein the cylindrical structure is provided on the exterior circumference thereof with a means for flowing a medium for heating or cooling and optionally on the outside of the means with a means for allowing an insulating material t exist.

The term "dispersion" used herein is usually used in a broader sense in physics and involves such embodiments as a heterogeneous mixing of a liquid phase with another liquid phase immiscible therewith (emulsion) and a fine mixing of a liquid phase with a solid phase insoluble thereinto (dispersion or suspension).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 5-*a* is an enlarged schematic longitudinal cross-sectional view of the dispersion chamber, showing the relation between the dispersion chamber and the rotary blade;

FIG. 5-*b* is a transverse cross-sectional view of the dispersion chamber in FIG. 5-*a* cut along the line A—A';

FIGS. 13 and 14 are transverse cross-sectional views showing two examples of the rectifying bearing;

FIG. 15 is a drawing for explaining the function of the rectifying bearing shown in FIG. 14.

DETAILED DESCRIPTION OF THE PREFERRED EMBODIMENT

Figure 1:
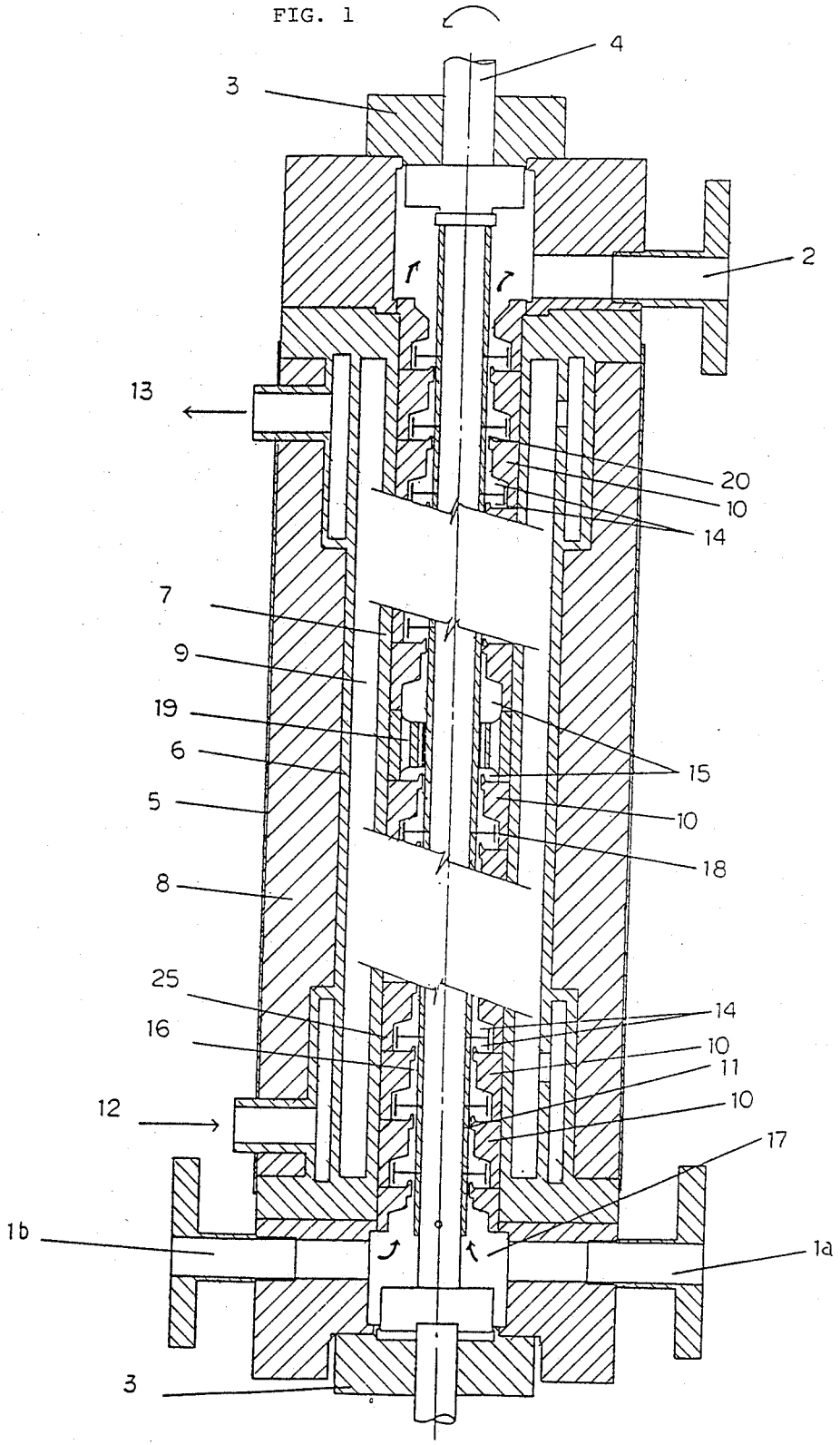
FIG. 1 is a schematic longitudinal cross-sectional view of an embodiment of the continuous dispersion apparatus the present invention provided with a means for flowing a medium for heating or cooling and with a means for allowing an insulating material to exist, a part of which is omitted for easy and better understanding.

The continuous dispersion apparatus of the present invention will now be explained hereinafter in detail, referring to the drawings.

FIG. 1 is a schematic longitudinal cross-sectional view showing a preferable example of the continuous dispersion apparatus of the present invention having multi-step dispersion chambers wherein the apparatus is used in an upright position. A fundamental part of the apparatus of this invention comprises a cylindrical structure. The cylindrical structure has on one end thereof a plurality of inlets 1*a* and 1*b* for starting (introducing) materials and a rotary shaft 4 positioned in the center of the longitudinal axis of the cylindrical structure and supported by a sealing bearing. The bearings 3 also function as a sealing assembly at both of the terminal ends of the cylindrical structure. A cover 5 is used as need and is used together with a mantle 6 for regulation of the temperature of this continuous dispersion apparatus. The mantle 6 is positioned on the outside of a wall 7 of the cylindrical structure, and an insulating material 8 is packed between the cover 5 and the mantle 6. A medium 9 for heating or cooling is introduced between the mantle 6 and the wall 7 of the cylindrical structure. In the interior of the cylindrical structure, there exist a plurality of distance collars 10. Fundamentally, each of these distance collars 10 is in the form of a hollow cylindrical block and the diameter of the hollow part is at least larger than the diameter of the rotary shaft. The outer circumference of the rotary shaft 4 may be covered with a hollow sleeve 11. A hollow zone or space is formed between adjacent distance collars 10 to define a dispersion chamber 14. In case a bearing 19 for the rotary shaft is positioned between the distance collar 10 and an adjacent distance collar 10, two spaces are also formed between the two distance collars 10 vicinal to both sides of the bearing, thus defining a rectifying chamber 15. This rectifying chamber changes the turbulent flow of the fluid to a laminar flow as will be discussed hereinbelow. Between the distance collar 10 and the rotary shaft 4 or the sleeve 11, an annular slit is formed, through which, as a passageway 16, starting material currents introduced from inlets 1*a* and 1*b* and combined in a starting material-supplying chamber 17 formed on the circumference of the rotary shaft is passed. The rotary shaft 4 or the sleeve 11 is equipped with a rotary blade 18 having shearing edges which extends at the right angle to the longitudinal axis of the rotary shaft. The rotary blade 18 is entered in the dispersion chamber 14. A rectifying bearing 19 provided so as to separate the rectifying chamber 15 into two portions is fixed around a cylindrical outer portion (outer circumference) thereof to the wall 7 of the body and is contacted at an inner portion (inner circumference) thereof partially with the rotary shaft 4 or the sleeve 11 thereof. The use of the sleeve 11 is convenient for mounting the rotary blade 18 to the shaft 4 and is used for protection thereof. This is due to the reason that as the rotary shaft 4 is rotated at a high speed and thus tends to undergo abrasion, the use of the sleeve protects the shaft 4 from abrasion and the life of the whole apparatus can be extended requiring only the sleeve to be exchanged after a period of use. Thus, the present invention is economically desirable.

Figure 2:
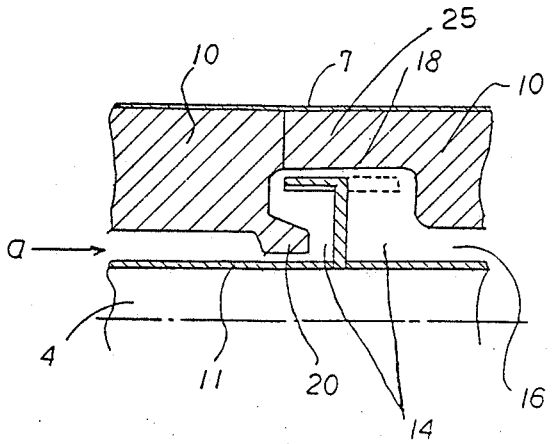
FIG. 2 is a schematic longitudinal cross-sectional view of the dispersion chamber.

In FIG. 2 showing the dispersion chamber 14 is shown in detail. The starting material current a is introduced into the dispersion chamber through a passageway 16, i.e. an annular slit formed between the inner circumferential wall of the distance collar 10 and the sleeve 11. The inner tip of the distance collar 10 forms an orifice mouthpiece 20 extending in the direction in which the starting material current a moves and toward the center axis. The starting material a flows in a turbulent state in the dispersion chamber 14 and through an orifice between the orifice mouthpiece 20 and the sleeve 11. Together with the rotary shaft 4, the rotary blade 18 with shearing edges is rotated at a high speed. The rotary blade 18 is fixed to the rotary shaft 4 through the sleeve 11 so as to be at a right angle to the axial direction of the rotary shaft. The starting material current a flowing in a turbulent state in the dispersion chamber 14 undergoes a strong shearing action by the rotary blade 18 having shearing edges so that the mixing and dispersion of the current is highly promoted. The starting material current a thus treated is again allowed to pass through a passageway 16 in the form of a slit between the sleeve 11 and the distance collar 10 and sent to a second dispersion chamber where the current undergoes a similar treatment. The starting material current is further sent to the subsequent dispersion chambers for repeated mixing and dispersion and then to the rectifying chamber 15.

Figure 3:
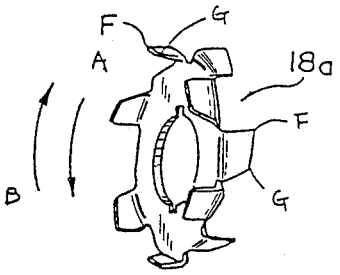
FIG. 3 is a perspective view of an example of the rotary blade having shearing edges.
Figure 4:
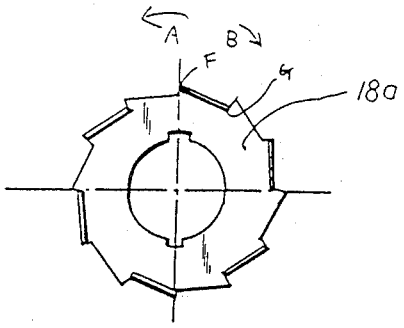
FIG. 4 is a front view of an example of the above described rotary blade.

In FIGS. 3 and 4, the blade portion 18*a* of the rotary blade 18 has portions of a side-cutter type as shearing .edges, which are bent alternately in opposite directions. This edge portion has a point F with a sharp angled portion and a point G as an obtuse angled portion. This rotary blade 18 is rotatable in either direction of A or B. In general, the rotation in the direction of B is ordinary but the rotation in the direction of A achieves a higher efficiency in the apparatus of this invention for the reason as will be described hereinafter.

In FIG. 5-*a*, each dispersion chamber 14 houses the rotary blade 18 having the shearing edges of a side-cutter type which are alternately bent in opposition directions. The rotary blade 18 is positioned in the dispersion chamber 14 in such a manner that the circumference of the rotary blade 18 is entirely surrounded with the distance collar 10 forming the dispersion chamber 14. The diameter D of the blade and that of the dispersion chamber are desirably determined in such a manner that the front end edges of the rotary blade 18 may be positioned in a boundary layer portion formed between the starting material current a and the sleeve position 25 (Theory of Prandth referred to). In the apparatus of this invention wherein the orifice mouthpiece 20 is provided by the distance collar 10, the ejection of the starting material current a under high pressure can prevent the formation of any dead space in the dispersion chamber 14 so that the rotation energy of the rotary blade 18 can effectively be converted to shearing energy, emulsifying energy, turning energy, dispersion energy, etc.

In FIG. 5-*b*, the dispersion effect according to the direction of rotation of the rotary blade is better in the direction A than direct B. The diameter 18*a* of the rotary blade portion (D in FIG. 5-*a*), the thickness of the wall 7 of the body, the thickness of the sleeve position 25 of the dispersion chamber 14, and the relation in space between the diameter 18*a* of the rotary blade 18 and the sleeve position 25 can visibly be understood from FIGS. 5-*a* and 5-*b*. In case of the diameter of the rotary blade 18 being D in one example, the diameter of the sleeve position 25 of the dispersion chamber is 1.05–1.1 D and the clearance between the blade 18 and the sleeve position 25 is 0.025–0.05 D. Further, the clearance between the blade 18 and the orifice mouthpiece 20 of the distance collar 10 is 0.02–0.04 D while the length d of the portion at the tip of the blade 18 alternately bent in opposite directions is 0.2–0.4 D and the length of the sleeve portion 25 is slightly larger than the length d. The clearance between the inner wall of the distance collar 10 and the blade 18 is about 0.005–0.1 D, and the length of the distance collar 10 except the sleeve position, i.e the length of the portion forming the annular slit and the orifice is about 0.5–1.0 D. These ratios show one example of the standard size of the individual parts and vary according to the viscosity and flow speed of the starting material current, the materials consisting of the apparatus and the shape of the surface, etc.

Figure 6:
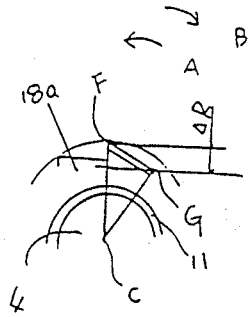
FIG. 6 is a drawing for explaining the effect of the rotary blade having shearing edges shown in FIG. 4.
Figure 7:
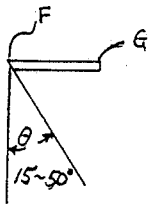
FIG. 7 is a drawing for explaining the effect of the tip of the shearing edges.

In FIG. 6 the fact that the rotation of the rotary blade 18 in the direction A is preferably for efficiency is explained. In the blade 18*a*, the point F which is a distant from the point G by $\Delta R$ in the diametric direction is considered to be a point of collision. In this case, a higher energy is created theoretically in the point F by a difference of $\Delta R \times 2 \times \pi$ in circumferential rotation speed than in the point G so that the formation of a higher cavitation is found. As shown in FIG. 7, the point F forms a knife edge of $\theta(15°-50°)$ serving to minimize the particle size by a greater shearing force produced by the rotation. This rotary blade 18*a* is suited for emulsification, dispersion and mixing of various starting material currents having low to high viscosities of 1–200,000 cps and effective for the production of cream, emulsion or the like having a high viscosity.

Figure 8:
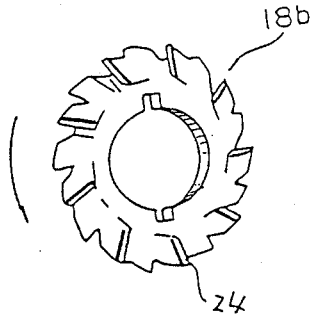
FIG. 8 is a perspective view showing another example of the rotary blade having shearing edges.
Figure 9:
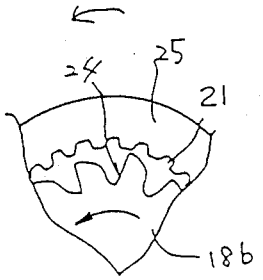
FIG. 9 is a partial transverse cross-sectional view showing the relationship between the rotary blade shown in FIG. 8 and a sleeve.

In FIGS. 8 and 9 another example 18*b* of the rotary blade 18 is shown. In blade 18*b*, the shearing edge 24 projects at a certain angle from the surface of the body of the rotary blade and is suitable for dispersion of a solid such as a pigment for which pulverization and crashing are necessary with a strong shearing blade. In case of dispersing a liquid phase, the rotation of a rotation blade 18*b* gives a strong surface pressure by the action of specific edges 24 and greater crashing force and shearing force are imparted by a synergistic effect of centrifugal force by rotation and the surface pressure to the current being pressurized by the surface pressure so that dispersion of the current is strongly effected. In the distance collar 10 especially shown in FIG. 9, tooth-shaped slits are formed on the sleeve position 25 so that the fluid runs once toward the inside of the sleeve position and then undergoes the action of the edge 24, thus exerting significant hearing force.

Figure 10:
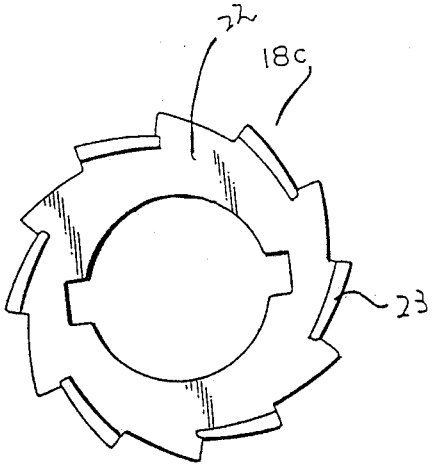
FIG. 10 is a front view showing still another example of the rotary blade having shearing edges.
Figure 11:
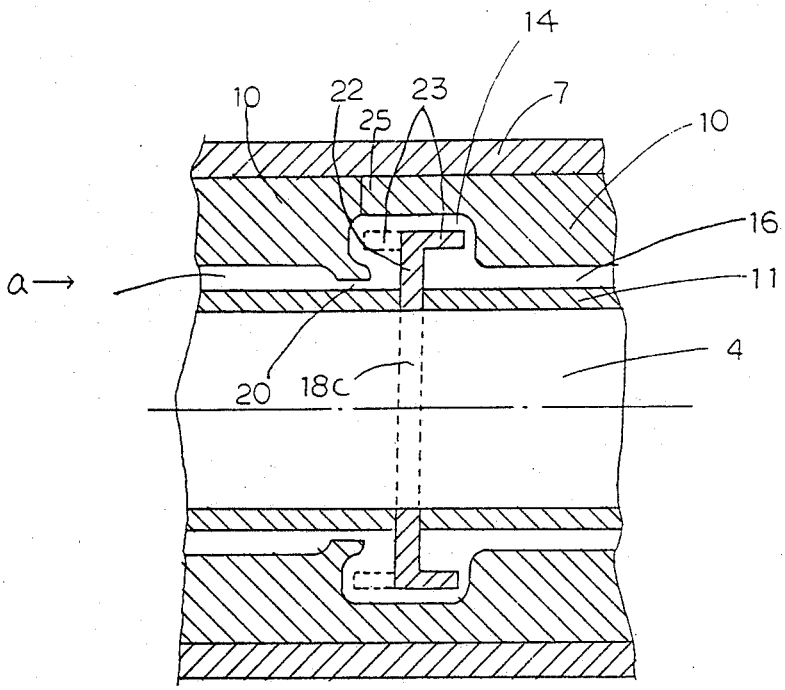
FIG. 11 is a schematic longitudinal cross-sectional view showing the relation between the rotary blade and the dispersion chamber in case of using the rotary blade shown in FIG. 10.

In FIGS. 10 and 11 still another example 18*c* of the rotary blade 18 is shown. In this example, the blades 23 having shearing edges of the rotary blade 18*c* are mounted to the periphery of a basal plate 22 to be fixed to the rotary shaft 4 in such manner that they face alternately in opposite directions. Especially in FIG. 11, the shape of the dispersion chamber 14 is formed in compliance with the shape of the blades 23 of the rotary blade 18*c* so that no dead space exists in the dispersion chamber 14 and dispersion can be effected efficiently.

Figure 12:
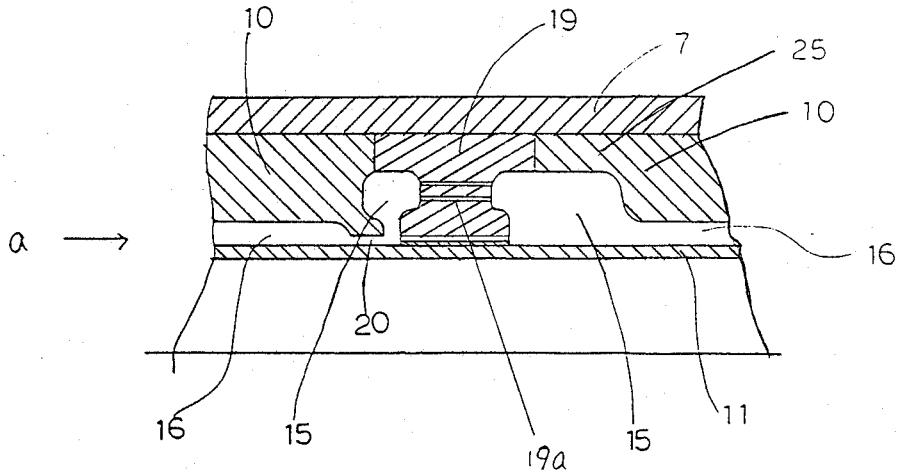
FIG. 12 is a schematic longitudinal cross-sectional view showing the rectifying chamber.

In FIG. 12, an annular rectifying bearing 19 is shown in the rectifying chamber 15, with its outer circumferential part being fixed to the wall 7 of the body. In other words, the rectifying chamber 15 is separated into two portions by the rectifyinq bearing 19 and the two separated rectifying chambers 15 are mutually in communication by slits 19*a* which function as a passageway 19*a* for a fluid.

FIG. 13 shows the case of the slit 19*a* each being a small cylindrical slit having a diameter of several millimeters. In this example, these small cylindrical slits are arranged, two in each case, at a definite interval in the radial direction. FIG. 14 shows an example wherein the slit 19*a* are different in shape from and large in space than that shown in FIG. 13 and has a plurality of slits (3 slits) are arranged at a given interval. In both drawings, a portion of the rectifying bearing in contact with the rotary shaft 4 or the sleeve 11 has a plurality of (three) small eccentric slits 19*b* and somewhat larger slits 19*c*.

The starting material current a passed through the dispersion chamber 14 retains a residual shearing stress by the action of the rotary blade 18 with an axially rotating flow by the rotation of the rotary shaft 4 and is entered in the rectifying chamber 15 and in front of the rectifying bearing 19. By the rectifying bearing 19, the starting material current a is separated into two streams, one of which is allowed to pass through the cylindrical slits of several millimeters arranged radially or somewhat larger slits 19*a* and stabilized or homogenized and the other of which is introduced by the rotation of the rotary shaft 4 into the slit 19*b* in a very small amount and into the slit 19*c* in the remaining amount. In the slit 19*c*, the stream achieves a centrifugal force by the rotation of the rotary shaft 4 and creates internal stress by the slit 19c. The stream further creates a higher internal stress by entering in the very small slit 19b from the slit 19c so that any swing of the shaft 4 by resonance is prevented by the forces in three directions exerting from the very small slits 19b toward the shaft 4, showing the effect as auto-centering as indicated in FIG. 15. This results in minimizing fluctuation of the shearing point in the dispersion chamber and contributes to enhancement of dispersibility.

FIG. 15 visibly shows the function of the rectifying bearing 19 with the auto-centering function.

The apparatus of the present invention can be used in a vertical or horizontal direction with respect to the central axis of the cylindrical structure. However, the use in a vertical position, i.e. an upright position makes the operation more efficiently by utilization of gravity. A problem of the generation of bubbles, etc. can be solved except in the case of the initial stage of the process. Further, it is also advantageous that during the rotation of the rotary shaft 4, its eccentricity is minimized by the gyrostatic action according to the principle of tops. The material for the apparatus can properly be selected from metals, glass-lined materials, ceramics, synthetic resins, etc. The size of the apparatus is properly determined according to the intended purpose, the amounts of starting materials, etc.

The size and number of the dispersion chambers and the size and number of the rectifying chambers as well as the order and arrangement of these can adequately be determined according to the desired use. A preferable embodiment for the arrangement of the dispersion chambers and the rectifying chambers is shown in Table 1.

According to the properties of substances and materials to be used as starting materials, the properties of products, etc., a medium for heating or cooling such as hot water or cold water can be introduced into a space between the mantle 6 and the cylindrical structure 7. In case the difference in temperature between the ambient temperature and the temperature of the medium is significant, a cover 5 as a temperature-maintaining means may optionally be employed and a space between the cover 5 and the mantle 6 may be charged with a heat-insulating material such as asbestos, glass wool, kapok and the like to enhance the efficiency for maintaining the temperature.

The dispersion operation of the apparatus of the present invention is carried out follows:

(1) Starting material currents are introduced from the inlets 1a and 1b for starting materials and are mixed in the mixing chamber 17 and a mixed stream flows in the axial direction through passageway 16 formed between the rotary shaft 4 or the sleeve 11 and the distance collar 10 into the dispersion chamber 14 via the orifice mouthpiece 20.

(2) In the dispersion chamber 14, a laminar flow is rapidly converted to a turbulent flow especially by the rotation of the rotary blade 18 and the confined dispersion chamber surrounding the blade whereby a dispersion effect is efficiently exerted.

(3) The starting material current repeatedly dispersed in the dispersion chambers is thermally stabilized in the passageway 16 and introduced into the rectifying chamber 15. The current is converted to a laminar flow by the slits 19a and 19c provided in the axial direction in the rectifying bearing 19 in the rectifying chamber 15 and again introduced into the passageway 16 between the distance collar 10 and the shaft 4 or the sleeve 11.

(4) By thus repeating the laminar flow action and the turbulent flow action by providing a plurality of dispersion chambers and an arbitrary number of rectifying chambers, the starting material current is homogeneously and entirely dispersed and the dispersed product is discharged from an outlet 2 for the product.

The apparatus of the present invention has the following advantages:

(1) A homogeneous dispersion is attained within a short period of time by repeating the process wherein materials to be treated are passed through very small slits while being stabilized terminally and rapidly diffused in the dispersion chambers and by passing the current through the rectifying chamber where the current is made stable.

(2) In a batchwise dispersion apparatus, a dead space is usually formed. In the apparatus of the present invention, however, no dead space is formed and loss of energy is small by providing each dispersion chamber with an orifice mouthpiece at the entrance thereof and arranging the front end of the rotary blade so as to shear the boundary layer of the current.

(3) The blade of the rotary blade has a shape not in possession of any propelling power so that control of the amount of the flowing current can easily be carried out. As the blade has a shape capable of obtaining a high cavitation state to such a degree that bubbles are not generated, an extremely good dispersion effect is exerted by impact in the limited dispersion chambers in a high cavitation state and by the shearing force of the rotary blade.

(4) In the past, severe selection, administration and control are necessary for properties of starting materials and operation conditions including especially the mixing method in order to control the particle size distribution in a very narrow range or to obtain a dispersion wherein the particle size is as small as about 0.011–0.5μAccording to the apparatus of the present is obtained without the necessity of such strict selection, administration and control.

(5) Conversion of high energy is easily made so that the amount of a surfactant conventionally required may be reduced to about ½.

(6) The apparatus can be constructed in a significantly compact size, e.g. about 1/10 as small as a batchwise emulsifier.

(7) Products are obtained continuously without the necessity of any operation for a preliminary dispersion. Further, a worker-free automation process is possible for the operation and control thereof.

Table 2 is a table for comparison of features of the apparatus of the present invention with generally reported emulsifiers. As are evident from the comparative table, the merits of the apparatus of this invention are summarized as follows:

1. A continuous treatment is possible without of necessity of any preliminary mixing.

2. Although the apparatus is for a continuous treatment, it is applicable to a viscosity over a wide range with respect to the viscosity of materials to be treated.

3. A shearing energy is compulsorily given to the starting material current in a narrow space dispersion chamber so that loss of energy is minimized and the energy can significantly be saved as compared with the prior art apparatus.

4. As the energy for dispersion is stable, no fluctuation occurs in particle diameter add the desired particle size is always obtained in a steady manner.

5. As the apparatus is provided with a means for controlling temperature, no problem will arise in the dispersing operation for thermally unstable materials.

Given below are Experimental Examples wherein the continuous dispersing apparatus of the present invention having a multi-step dispersion chambers are used. It is to be construed that utilization of the present invention is not limited to these examples.

Experimental Example 1

A high inner phase (high oil content) oil-in-water type emulsion:

To an aqueous phase prepared by heating 16 parts of water and an adequate amount of a sugar at 80°-85° C. a surfactant phase comprised of 6 parts of 1,3-butylene glycol and 6 parts of polyoxyethylene hardened castor oil (100E·O) was added. After dissolving (or homogenizing) the surfactant phase, an oily phase prepared by adding adequate amounts of a preservative and antioxidant to 15 parts of olive oil, 37 parts of liquid paraffin, 7 parts of vaseline and 5 parts of beeswax and heating the mixture at 50°-60° C. was added to the homogenized phase under agiation. The resultant mixture is then passed continuously through the apparatus of this invention (Dispersion Conditions: the number of dispersion chambers 6, the capacity of dispersion chambers about 15 $cm^3$, the speed for transporting the mixture 0.4 l/min, the shape of blades 18*a* and the number of rotation of the blades 8,000 r.p.m.) and cooled whereby a stable oil-in-water type emulsion was obtained which had a particle diameter of 0.1-1.0μ.

Experimental Example 2

A high inner phase oil-in-water type emulsion:

To an oily phase prepared by adding adequate amounts of a preservative and an antioxidant to an oily substance comprising 15 parts of olive oil, 37 parts of liquid paraffin, 7 parts of vaselin, 5 parts of beeswax and 6 parts of polyoxyethylene hardened center (100 E O) and heating the mixture at 50°-60° C. was added under agitation an aqueous phase prepared by adding an adequate amount of a sugar to 16 parts of water and 4 parts of 1,3-butylene glycol and heating the mixture at 50°-60° C. The resultant mixture was then passed continuously through the apparatus of this invention (Dispersion Conditions: the number of dispersion chambers 6, the capacity of dispersion chambers about 15 $cm^3$, the speed for transporting the mixture 0.4 l/min., the shape of blades 18*a* and the number of rotation of blades 8,000 r.p.m.) and cooled whereby a stable oil-in-water type emulsion was obtained which had a particle diameter of 0.1-1.0μ.

Experimental Example 3

An oil-in-water type emulsion:

To an oily phase prepared by warming at 75°-85° C. an oily component comprising 8 parts of a fatty acid, 3 parts of cetanol and 11 parts of squalane, as surfactant component comprising 1 part of polyethyleneglycol monostearate (150 E·O), 3 parts of sorbitan monostearate and 1 part of polyoxyethylenesorbitan monostearate (20 E.O), and adequate amounts of a preservative and an antioxidant was added with stirring an aqueous phase prepared by warming at 75°-85° C. 60 parts of water, 8 parts of 1,3-butylene glycol and 9 parts of propylene glycol. The resultant mixture was then passed continuously through the apparatus of this invention (Dispersion Conditions: the number of dispersion chambers 6, the capacity of dispersion chambers about 15 $cm^3$, the speed for transporting the mixture 0.6 l/min., the shape of blades 18*a* and the number of revolution of blades 6,000 r.p.m.) and cooled whereby a stable emulsion was obtained which had a particle diameter of 1.0-3.0μ.

Experimental Example 4

An oil-in-water emulsion:

To an oily phase prepared by warming at 70°-80° C. 10 parts of liquid paraffin, 9 parts of microcrystalline wax and 16 parts of a silicone oil and 1 part of glycerol monostearate was added with stirring an aqueous phase prepared by warming at 70°-80° C. 55 parts of water, 3 parts of ethyl alcohol, 5 parts of 1,3-butylene glycol and an adequate amount of a preservative. After the addition, 2 parts of a gelling agent (LAPONITE XLG, Veegum HV) was dispersed further in the mixture. The resultant mixture was then passed through the apparatus of this invention (Dispersion Conditions: the number of dispersion chambers 6, the capacity of dispersion chambers about 15 $cm^3$, the speed for transporting the mixture 0.6 l/min., the shape of blades 18*a* and the number of rotation of blades 6,000 r.p.m.) and cooled whereby an oil-in-water type dispersion was obtained which had a particle diameter of 1.0-3.0μ.

Experimental Example 5

A water-in-oil type emulsion:

To an oily phase prepared by warming at 80°-85° C. a mixture of an oily component comprising 2 parts of solid paraffin, 3 parts of beeswax and 13 parts of liquid paraffin, a surfactant component comprising 3 parts of diglyceryl monoleate, and an adequate amount of a preservative and an antioxidant was added with stirring an aqueous phase prepared by adding 7 parts of a 54% aqueous solution of Maltitol to 67 parts of water and 5 parts of 1,3-butylene glycol and warming the mixture at 80°-85° C. The resultant emulsion was then dispersed under the same conditions as described in Experimental Example 1 whereby a stable water-in-oil type emulsion was obtained which had a particle diameter of 2.0-3.0μ.

Experimental Example 6

A pigment dispersion in an oily medium:

An adequate amount of an antioxidant was added to a mixture of 50-75 parts of castor oil, 7-10 parts of cetyl 2-ethylhexanoate, 3-5 parts of asilicone oil and 0.9-1.5 parts of polyoxyethylene polyoxypropylene cetyl ether. Further, 10-30 parts of a combination of a tar pigment and a white pigment each capable of being used for cosmetics was preliminarily dispersed in the mixture. The resultant mixture was continuously passed through the apparatus of this invention (Dispersion Conditions: the dispersion chambers 11, the capacity of the dispersion chambers about 15 $cm^3$, the speed for transporting the mixture 0.5 l/min., the shape of blades 18*b*, sleeve position 25 and the number of rotation of blades 8,000 r.p.m.) while being cooled whereby any exothermic phenomenon could be prevented and pigment dispersion with a particle diameter of 5-20μ was obtained.

Experimental Example 7

A pigment dispersion in an oily medium:

In 45 parts of squalane and 1 part of sorbitan sesquioleate was preliminary dispersed 5-25 parts of an inorganic pigment. The resultant mixture was continuously passed through the apparatus of the present invention (Dispersion Conditions: dispersion chambers 11, the capacity of the dispersion chamber about 15 $cm^3$, the speed for transporting the mixture 0.5 l/min., the shape of blades 18*b* sleeve position 25 and the number of rotation of blades 8,000 r.p.m.) while being cooled whereby any exothermic phenomenon could be prevented and a pigment dispersion with a particle diameter of 5–20$\mu$ was obtained.

ously passed through the apparatus of the present invention (Dispersion Conditions: the dispersion chambers 11, the capacity of the dispersion chambers about 15 $cm^3$, the speed of transporting the mixture 0.5 l/min., the shape of blades 18*b*, sleeve position 25 and the number of rotation of blades 8,000 r.p.m.) while being cooled whereby any exothermic phenomenon could be prevented and a pigment dispersion with a particle diameter of 5–20$\mu$ was obtained.

TABLE 1

| | Number of Dispersion Chambers | Number of Rectifying Chambers | Number of Chambers | Arrangement Pattern ○ Dispersion Chamber ● Rectifying Chamber | Volume of Flow l/min | Shape of Blade | Number of Revolution HM | Particle Diameter $\mu$ | Remarks |
|---|---|---|---|---|---|---|---|---|---|
| Oil-in-water type Emulsion A | 6 | 2 | 8 | ○○●○○●○○ | 1–10 | 18a | 6000 | 4.5–5.5 | |
| Water-in-oil type Emulsion A | 6 | 2 | 8 | ○○●○○●○○ | 1–10 | 18a | 6000 | 4.5–5.5 | |
| Oil-in-water type Emulsion B | 6 | 1 | 7 | ○○○●○○○ | 0.4–4 | 18a | 6000 | 1.0–3.0 | |
| Water-in-oil type Emulsion B | 6 | 1 | 7 | ○○○●○○○ | 0.4–4 | 18a | 6000 | 1.0–3.0 | |
| High inner phase oil-in-water type Emulsion | 12 | 1 | 13 | ○○○○○○●○○○○○○○ | 0.4–4 | 18a | 8000 | 0.1–1.0 | |
| High inner phase water-in-oil type Emulsion | 12 | 1 | 13 | ○○○○○○●○○○○○○○ | 0.4–4 | 18a | 8000 | 0.1–1.0 | |
| Micro-emulsion | 12 | 2 | 14 | ○○○○●○○○○●○○○○ | 0.3–3 | 18a | 12000 | 0.05–0.1 | |
| Pigment dispersion (Oil phase dispersion Water phase dispersion) | 12 | 1 | 13 | ○○○○○○●○○○○○○○ | 0.5–10 | 18c | 8000 | 5–20 | Sleeve position of 10, concavoconvex shape |

TABLE 2

Comparison in Performance of Various Emulsifying Apparatus

| Physical properties | High-Shearing Dispersion apparatus (5,000 ft/min) | Roll mill | Circumferential Speed of Rotor of Colloid mill (ft/min) 5,000 | 10,000 | Ball mill | Homogenizer | Apparatus of this invention |
|---|---|---|---|---|---|---|---|
| Range of viscosity (cp) | 5,000–2 × 10 | $10^3$–$10^5$ | 1,000–3 × $10^4$ | 1–5,000 | 300–6,000 | 1–2,000 | 1–200,000 |
| Optimum viscosity (cp) | 5 × $10^4$ | — | 15,000 | 2,000 | 500–2,400 | 1–200 | 5,000–10,000 |
| Range of particle diameter ($\mu$) | 1–100 | 0.5–50 | 2–100 | 1–100 | 0.5–100 | 0.5–20 | 0.01–100 |
| Optimum particle diameter ($\mu$) | 2 | 0.5–1 | 2–4 | 1–3 | 1 | 0.1–2 | 0.1–2 |
| Range of capacity | 1–5,000 gal | 6–28 lb/h (Per in. of Roll length) | 8–150 gpm | 8–160 gpm | 1 qt–2,000 gph | 15–14,000 gph | 4–1,000 l/hr |
| Range of horse power | 1–200 | 1–60 | 2–200 | 2–200 | — | 2–200 | 1–60 |
| Discrimination of "Continuous" or "batchwise" | Batchwise | Batchwise | Continuous | Continuous | Batchwise and Continuous | Continuous | Continuous |
| Adequateness to low boiling point solvents | No | No | Yes | Yes | Yes | Yes | No |
| Adequateness to a pressurized system | No | No | Up to 100 psi | Up to 100 psi | 15 psi Normal pressure | Up to 10,000 psi | 1.5 psi Normal pressure |
| Adequateness to an aqueous phase | Yes | No | Yes | Yes | Yes | Yes | Yes |
| Pulverization capacity | No | No | No | No | Yes | No | No |
| Necessity of Preliminary Mixing | No | Yes | Yes | Yes | No | Yes | No |

(Excerpted from General Data on New Surfactants, The publishing department of Keiei-Kaihatsu Center, published on January 1 of Sho. 55)

Experimental Example 8

A pigment dispersion in an aqueous medium:

In 50 parts of water and 30 parts of polyethylene glycol (200) was preliminarily dispersed 5–25 parts of an inorganic pigment. The resultant mixture was continu- The continuous dispersion apparatus of the present invention can efficiently produce a well homogeneously dispersed product without the necessity of any preliminary dispersion of the starting materials and therefore can be utilized widely for the manufacture of cosmetics, for example, creams and emulsions for cosmetic use. The present invention can also be utilized for the manufacture of various foods such as edible creams, dressings and soaps, paints containing very fine pigments in a homogeneously dispersed state, and liquid fuels containing very fine solid, for example, coal in a dispersed state. Further, the present invention can be used in the manufacture of car waxes and the like industrial materials, solid phase-liquid phase dispersions and liquid phase-liquid phase dispersions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A continuous dispersion apparatus comprising:

a cylindrical structure having two ends with a sealing assembly on both ends thereof provided with at least one inlet for introducing materials and an outlet for a dispersion product;

a rotary shaft extending in the cylindrical structure in a lengthwise direction along a central axis thereof, said rotary shaft extending beyond both ends of said cylindrical structure and having a circumferential surface;

a plurality of dispersion chambers each having an inlet and outlet, said chambers being positioned within said cylindrical structure and being arranged along the rotary shaft for dispersing a starting material current from the inlet in the dispersed chambers and for discharging a dispersed product the outlet thereof;

a starting material-supplying chamber positioned within the cylindrical structure at one end thereof and having a space defined by at least the circumference of the cylindrical structure, said chamber permitting passage of the materials introduced from the at least one inlet;

a plurality of aligned distance collars extending along the cylindrical body, said dispersion chambers being arranged on the circumference of the rotary shaft from one end to the other end thereof and along the central axis, each of the dispersion chambers consisting of a space defined by the circumferential surface of the rotary shaft and adjacent distance collars, the distance collars being fixed to an inner wall of the cylindrical structure and forming together with the circumferential surface of the rotary shaft an annular slit which constitutes a passage for the starting material current supplied from the starting material-supplying chamber;

a rotary blade provided in each of the dispersion chambers and having shearing edges, said rotary blade being fixed to the rotary shaft and extending therefrom generally at a right angle to the lengthwise direction of the rotary shaft; and at least one rectifying chamber provided along the cylindrical structure between at least two of the dispersion chambers, said rectifying chamber having a plurality of small gaps which constitute passageways for the starting material current, whereby said starting material current travels through said at least one inlet, said starting material-supplying chamber, at least one dispersion chamber wherein said current has turbulent flow and then through said rectifying chamber wherein said current has a laminar flow and then through another dispersion chamber wherein said current again has a turbulent flow and then through said outlet in order to produce the dispersed product.

2. The continuous dispersion apparatus according to claim 1, wherein the cylindrical structure is in an upright position.

3. The continuous dispersion apparatus according to claim 2, wherein an inside part of the distance collar further extends toward the circumference of the rotary shaft to form an orifice mouthpiece.

4. The continuous dispersion apparatus according to claim I, wherein an inside part of the distance collar further extends toward the circumference of the rotary shaft to form an orifice mouthpiece.

5. The continuous dispersion apparatus according to claim 1, wherein the cylindrical structure is in an upright position.

6. The continuous dispersion apparatus according to claim 1, wherein an inside part of the distance collar further extends toward the circumference of the rotary shaft to form an orifice mouthpiece.

7. The continuous dispersion apparatus as recited in claim 1, further comprising means for circulating a medium for one of heating and cooling of the material current, said means for circulating being provided on the circumferential surface of said cylindrical structure.

8. The continuous dispersion apparatus as recited in claim 7, further comprising means for insulating said means for circulating.

* * * * *